United States Patent [19]

Miller et al.

[11] Patent Number: 4,925,423

[45] Date of Patent: May 15, 1990

[54] FABRIC PAPER DOLL

[75] Inventors: Lisa V. Miller; Virginia Lagow, both of Terrell, Tex.

[73] Assignee: Lagow Enterprise, Inc., Terrell, Tex.

[21] Appl. No.: 112,515

[22] Filed: Oct. 26, 1987

[51] Int. Cl.[5] ..... A63H 3/02

[52] U.S. Cl. ..... 446/98; 446/370; 446/387

[58] Field of Search ..... 446/98, 369, 370, 373, 446/387, 73, 374

[56] References Cited

U.S. PATENT DOCUMENTS

| | | | |
|---|---|---|---|
| 3,316,669 | 5/1967 | Nachbar | 446/98 |
| 3,475,852 | 11/1969 | Brosk | 446/73 |
| 3,855,730 | 12/1974 | Baer | 446/369 |
| 4,122,628 | 10/1978 | Crowell et al. | 446/98 |
| 4,165,555 | 8/1979 | Boxer et al. | 24/444 |
| 4,341,036 | 7/1982 | Yeu | 446/373 |
| 4,372,077 | 2/1983 | Balbuena | 446/327 |
| 4,579,537 | 4/1986 | Leahy | 446/100 |
| 4,671,514 | 6/1987 | Wilson-Diehl | 446/100 X |

FOREIGN PATENT DOCUMENTS

| | | | |
|---|---|---|---|
| 2600033 | 7/1977 | Fed. Rep. of Germany | 446/373 |
| 1253810 | 11/1971 | United Kingdom | 446/387 |
| 1406799 | 9/1975 | United Kingdom | 446/369 |

*Primary Examiner*—Mickey Yu

*Attorney, Agent, or Firm*—Johnson & Gibbs

[57] ABSTRACT

A fabric doll constructed in the shape of a "cut-out" paper doll and having certain resemblances to aesthetic features thereof. The doll is assembled in a laminate configuration having outer layers of bonded fabric and an interior pad of a polyester fiber cushion. A stiffening stay is secured in the neck region of the doll for providing rigidity and preventing the head of the doll from flopping over as is conventional with paper dolls and the like. Securement hook and loop strips are also utilized on the frontal surface of the doll for facilitating attachment of play clothes. In this manner, a simple and inexpensive structure closely resembling a paper doll but in a reuseable and washable configuration is provided for the benefit and enjoyment of a small child.

7 Claims, 1 Drawing Sheet

FABRIC PAPER DOLL

BACKGROUND OF THE INVENTION

1. Field of the invention

The present invention pertains to children's dolls and, more particularly, to a substantially flat fabric doll upon which can be attached and removed various articles of play clothing for children.

2. History of the Prior Art

The prior art is replete with doll structures constructed for the enjoyment of small children. These doll assemblies vary from inexpensive paper dolls that can be cut from scrap newspaper and the like to expensive porcelain dolls. The variety of doll design and construction is the result of a widespread popularity in dolls by both young people and adults. One aspect of adult interest is the lucrative market for doll sales and the sale of doll related items. This multi-million dollar industry has been the subject of numerous innovations in both doll construction and wearing apparel.

One of the most lucrative aspects of the doll market is that of doll clothing. The sale of accessory items for dolls has become a major market due to the fact that accessory items can become outdated, torn, soiled and lOst. This results in additional purchases. Moreover, accessory items can easily provide renewed interest in existing dolls fOr the very young user.

The accent upon accessory items for dolls has necessitated doll construction which lends itself to more durability and prolonged use. The design must be sufficiently innovative to generate and maintain the interest of a young user, and yet it must be priced sufficiently low to permit widespread market acceptance. Plastic dolls have proven to be the most versatile in design and durability while providing ample leeway for changes in clothing style. In many instances, the plastic doll is movable and is constructed with features very closely resembling that of more expensive dolls. These features include hair color, length, style, texture and significant facial detail. One problem area with such dolls is the cost. Although the majority of the accepted dolls in the market today are priced sufficiently low for the average consumer, it is not always economically feasible to purchase a plurality of identical dolls for purposes of multiple play. One of the advantages of the less expensive paper doll, which in certain instances has basically no cost, is that a number of identical paper dolls can be constructed and clothing interchanged between each. The fabrication of paper dolls is generally left to the imagination of the user. The fabrication material can vary from the most inexpensive paper (such as newspaper) to high gloss cardboard and other more exotic materials.

One common problem in the use of simple paper doll constructions is the variety of clothes that can be assembled therewith and the manner of attaching the clothes to the doll. Adhesives such as cement and tape are often used for securing fabrics to cardboard paper doll configurations. These are, of course, only temporary in nature because the adhesive will often lose its usefulness. At times this is a rather moot point, however, because the doll itself can become easily torn or misshapen due to the propensity of paper, cardboard and the like to bend, fold and crease and thereby lose its shape. Moreover, those areas of the doll such as the arms and the neck comprise the smallest cross-sectional regions of the doll and the regions which are most susceptible to the aforesaid folds and the resultant misshapen appearance.

As discussed, it is known in the prior art to make many forms of commercial and handmade dolls. For example, one may fabricate stuffed fabric dolls by stitching material panels together having padding or stuffing therebetween. However, such dolls are generally limp if the padding is not tightly padded or somewhat rotund if the doll is full of stuffing. The requisite degree of stiffness is not, in other words, generally found in substantially planar dolls that are not stuffed to the "rotund" state. Thus, "paper type" dolls that are cut out of fabric such as felt instead of paper are limp unless they have some backing, such as cardboard. Cardboard can, of course, develop creases and it detracts from the doll's appearance. These are but a few of the prior art problems.

It would be an advantage, therefore, to overcome the problems of the prior art by providing a doll configuration resembling a paper doll shape which does not suffer from the problems of paper dolls. One such design is provided by the method and apparatus of the present invention which provides a fabric paper doll constructed of sufficiently durable materials for allowing multiple use, cleaning and the renewed interest of the user. The doll is constructed for overcoming the "limpness" aspects found in thin paper dolls and incorporates means for affording stiffness to those regions of the doll which are ordinarily easily bent. This configuration is provided in an assemblance which is durable and yet lends itself to the interchange of replaceable garments and wearing apparel in an economical configuration that is affordable to a very wide market even in multiple purchase scenarios.

SUMMARY OF THE INVENTION

The present invention relates to fabric dolls formed in the shape of conventional paper dolls incorporating stiffening means and means for the replacement of wearing apparel thereon. More particularly, the present invention includes a fabric paper doll of the type having a head, a body, arms and leg regions. The doll comprises a substantially planar pad configured with the head, body, legs and arm regions. First and second fabric sections are configured for covering the substantially planar pad. The first fabric section is constructed with facial features thereupon for resembling the frontal region of a doll. The second fabric portion is constructed for resembling the rear portion of the doll. Means are provided for stiffening the doll in the upper body and head region thereof for facilitating durability. The first and second fabric regions are peripherally stitched one to the other for sandwiching the pad therebetween.

In another aspect, the invention includes an apparatus wherein the stiffening means comprises a thin, flexible stay and the pad comprises a polyester substrate, such as ¼ inch bonded, polyester padding. The stiffening means comprises a stay and the polyester substrate includes means for securement of the stay thereto. The first and second fabric coverings are comprised of polyester material bonded to a relatively stiff material backing.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
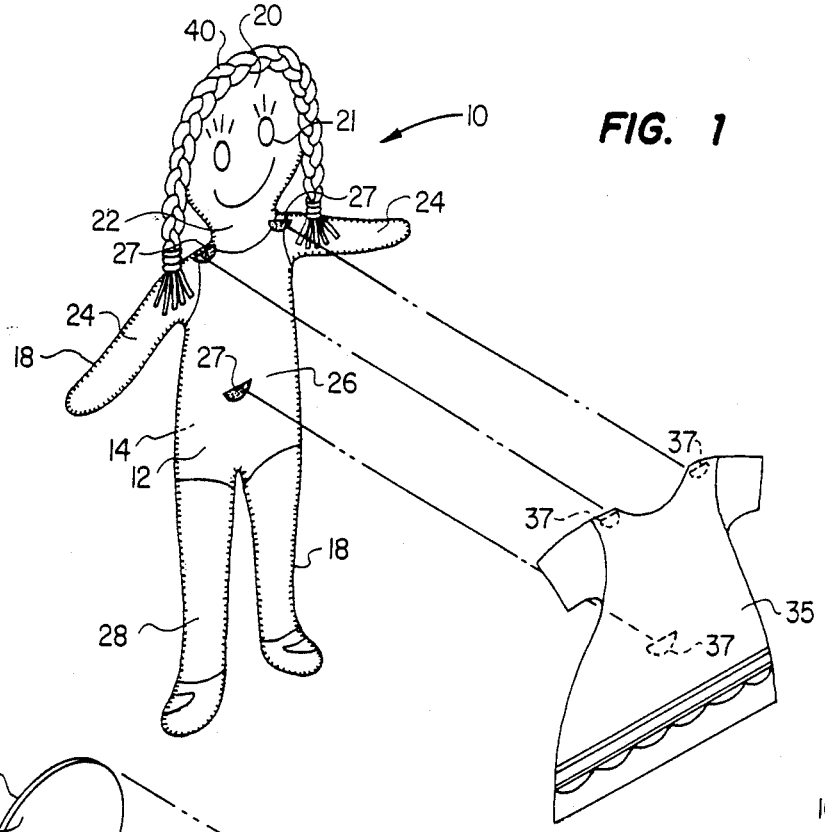
FIG. 1 is a perspective view of one embodiment of the doll constructed in accordance with the principles of the present invention.

Referring first to FIG. 1, there is shown one embodiment of a doll (10) constructed in accordance with the principles of the present invention. The doll (10) is formed of fabric and resembles a "paper type" doll and thus is referred to herein, and in the title, as a "Fabric Paper Doll". It is not, however, made of paper which is one of the key advantages herein.

The doll (10) is constructed of front and back layers of fabric (12) and (14) such as doll face polyester bonded to interfacing (15) (such as Pellon) with an intermediate layer of polyester wall padding (16) disposed therebetween. The doll (10) is further constructed with a tightly seamed outer peripheral portion (18) which compresses the sandwiched polyester filler (16) therewithin. The interfacing (15) is preferably of the "iron on" type for bonding to the polyester outer layers. The peripheral stitching (18) provides a tight seam engagement with, for example a zig-zag stitch for defining one degree of structural stiffening. The normal flaccid nature of the fabric and padding is thus overcome in a novel embodiment as described below. Appropriate stiffening members are thus utilized and secured within the doll (10) to further enhance the usefulness of the doll.

Still referring to FIG. 1, the doll (10) is constructed with a head (20) having a face (21) formed thereon. The face (21) incorporates the nOrmal features Of a dOll in a sufficiently simple configuration so as to resemble basic paper doll shapes and appearances. The face (21) is embroidered onto the head (20) rather than being painted on, which achieves a higher degree of permanence. Beneath the head (20) is disposed a neck region (22) within which is disposed a stiffening member as described in more detail below. Arms (24) extend outwardly from beneath the neck region (22), which arms are constructed in the laminate configuration described above. Beneath the arms (24) is disposed the upper body or torso (26) upon which are secured hook and loop snaps or attachment tabs (27). With these tabs various articles of clothing can be demountably attached thereto. Beneath the torso (26) extends a pair of legs (28). From the head (20) to the legs (28), there is provided a complete doll assemblage resembling a paper doll but fabricated from the requisite fabric to allow repeated washing, dressing and playful use thereof.

Figure 2:
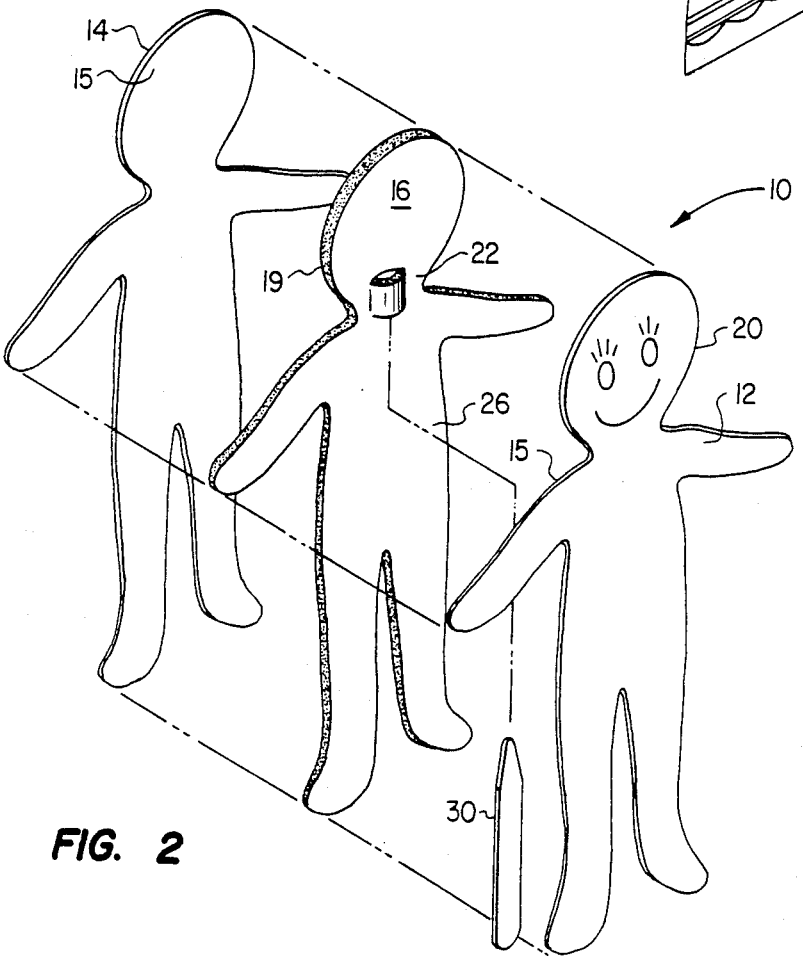
FIG. 2 is an exploded perspective view of the construction of the doll of FIG. 1.

Referring now to FIG. 2, there is shown an exploded perspective view of the doll (10) of FIG. 1. In this view the sandwiching configuration is most clearly illustrated whereby it is seen that a frontal panel (12) is secured to a back panel (14), both being cut in a complementary mating shape with a padded region (16) secured therebetween. The front and back doll-shaped panels are preferably made of 100% polyester doll face fabric comprising a tightly woven textile laminated onto interfacing (such as Pellon) by ironing or the like. The pad (16) is a looser polyester material (on the order of ¼inch thick) which affords softness as well as fullness to the doll. With the side edge seams (18), the pad is compressed along peripheral edge (19) in the direct vicinity of the stitching. Again the stitching in conjunction with the compressed pad (16) provides a stiffness to the doll which facilitates its usefulness as a durable toy. Since the fabric doll (10) resembles a paper doll and with the facial features (21) likewise resembling the simple facial features often attempted by young children on paper dolls, the stiffness as well as the softness of the doll (10) is a particularly advantageous aspect.

Still referring to FIG. 2, there is shown a stiffening member (30) disposed in the neck region (22) of the doll (10). The stiffening member (30) is provided in the form of a stay which extends upwardly into the head region (20) and downwardly into the torso region (26). In this way the upper torso of the doll in the vicinity of the head (20) and arms (24) as well as neck (22) has a somewhat stiff configuration unlike conventional paper dolls. As would be obvious to one considering the flexibility of a configured member such as a paper doll, the region of narrowest dimension would exhibit the most disadvantageous flexibility. Neck (22) is clearly the narrowest region between the head (20) and the arms (24) and therefore without the stiffening member it would normally bend or "flop over" simply under its own weight. The stiffening member may be comprised of plastic, or the like, and in a configuration similar to the collar stays conventionally found in shirts. Such stays are both waterproof and resistant to tearing. The play with the doll (10) would clearly expose the stays (30) to similar types of conditions due to the inherent ability to repeatedly wash the fabric doll.

Figure 3:
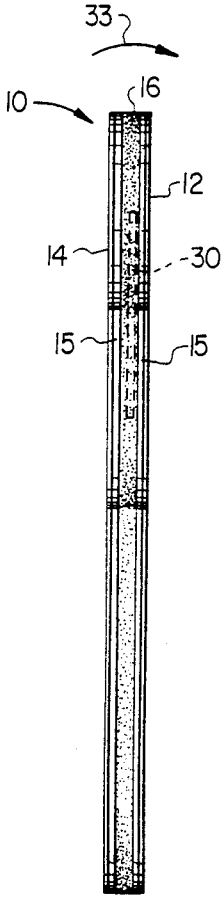
FIG. 3 is a side elevational view of the assembled doll of FIG. 2.

Referring now to FIG. 3, there is shown a side elevational view of the sandwiched assembly of FIG. 2 prior to seaming In this illustration, the pad (16) is seen sandwiched between the front and back panels (12) and (14), respectively, prior to the peripheral compression through stitching. In this view the stay (30) is illustrated although not clearly shown and thus phantom lines are necessary to fully represent said stay. The stiffening of the stay prevents the frontal flexing or bending of the head in the direction of arrow (33) illustrated therein. Other stay members could be disposed within the body of the doll (10) in accordance with the spirit and scope of the present invention.

Referring back to FIG. 1, there is shown a dress (35) disposed outwardly of the doll (10). The dress (35) includes a plurality of hook and loop attachments (37) secured underneath each side thereof. These are positioned in a configuration providing mating engagement with the hook and loop members 27 on the frontal surface of the doll (10). In this way, any blouse or dress which is particularly adapted for the design of the doll (10) can be demountably attached thereto. It should be noted that any number of dress and blouse size shapes, colors, configurations are contemplated in accordance with the spirit and scope of the present invention.

Addressing now FIGS. 1, 2, and 3 in combination, the material from which the doll (10) of the present invention is fabricated is preferably polyester and interfacing. Such material is machine washable and yet sufficiently durable to permit handling by small children. The facial surface (21) is applied in this particular embodiment by embroidery which affords a durable surface likewise resistant to marring and deterioration through normal child use. The ability to attach clothes as described above further facilitates the usefulness of the present invention. The hair (40) is preferably a woven textile or the like and machine sewn on to further facilitate versatility in hair color, design and durability in the doll (10).

Having described the invention in connection with certain specific embodiments thereof, it is to be understood that further modifications may now suggest themselves to those skilled in the art and it is intended to cover such modifications as fall within the scope of the appended claims.

What is claimed is:

1. A fabric doll comprising:

a substantially planar pad having head, neck, upper torso, lower torso, arms and legs regions;

first and second woven fabric sections configured for covering said substantially planar pad, said first woven fabric section being constructed with features which resemble a front part of said doll; and means for resiliently stiffening said doll only in said head, neck and upper torso regions, said resilient stiffening means comprised of a thin, flexible and self-supporting stay secured to the head, neck and upper torso portions of said substantially planar pad;

said first and second woven fabric sections being peripherally stitched one to the other for sandwiching said substantially planar pad there between;

wherein said stiffening means prevents the frontal flexing and bending of said head region and wherein said regions of said doll not stiffened by said stiffening means remain soft and unstiffened.

2. The apparatus as set froth in claim 1 wherein each of said woven fabric sections includes a peripheral region and wherein said peripheral stitching of said doll includes a zig-zag stitch for securing said peripheral regions thereof and compressing said pad between said first and second woven fabric sections for providing stiffness to said doll.

3. The apparatus set forth in claim 14 wherein said pad comprises a polyester substrate.

4. The apparatus as set forth in claim 3 wherein said polyester substrate includes means for securement of said stay thereto.

5. The apparatus as set forth in claim 1 wherein said doll further includes a hair member secured to said first woven fabric section, said hair member being formed of a woven textile.

6. The apparatus as set forth in claim 1 wherein said first woven fabric section further includes at least one hook and loop fastener element and said doll further includes at least one planar fabric resembling wearing apparel for said doll, said fabric resembling wearing apparel being constructed for securement to said hook and loop fastener whereby said fabric resembling wearing apparel can be mounted to and removed from said doll for play.

7. The apparatus as set forth in claim 6 and further including a plurality of hook and loop fasteners secured to said first woven fabric section for attachment of said fabric resembling wearing apparel thereto.

* * * * *